United States Patent [19]

Gerber

[11] Patent Number: 5,042,339

[45] Date of Patent: Aug. 27, 1991

[54] METHOD AND APPARATUS FOR CUTTING SUCCESSIVE SEGMENTS OF SHEET MATERIAL WITH CUT CONTINUATION

[75] Inventor: H. Joseph Gerber, West Hartford, Conn.

[73] Assignee: Gerber Garment Technology, Inc., Tolland, Conn.

[21] Appl. No.: 571,077

[22] Filed: Aug. 21, 1990

[51] Int. Cl.[5] ..... B26D 5/30; D06H 7/00

[52] U.S. Cl. ..... 83/49; 83/56; 83/76.6; 83/940

[58] Field of Search ..... 83/13, 49, 56, 76.1, 83/76.6, 76.9, 936-941

[56] References Cited

U.S. PATENT DOCUMENTS

| | | | |
|---|---|---|---|
| 3,939,742 | 2/1976 | Jung | 83/56 |
| 4,133,233 | 1/1979 | Pearl | 83/56 |
| 4,972,745 | 11/1990 | Bruder et al. | 83/936 X |

*Primary Examiner*—Frank T. Yost

*Assistant Examiner*—Eugenia A. Jones

*Attorney, Agent, or Firm*—McCormick, Paulding & Huber

[57] ABSTRACT

In a method and apparatus for cutting sheet material wherein the material is cut in bites or segments by bringing in stepwise fashion successive lengthwise segments to a cutting station incomplete cutting of a line or pattern piece when the line or pattern piece is continued from one segment to another is avoided by a retracing of the line of cut in the vicinity of the line's or pattern piece's transition from one segment to another. Therefore, when the cutting tool, following the advancement of the material to bring a fresh segment to the cutting station, is returned to the vicinity of a previously cut point it retraces a portion of the previously cut line to promote complete separation of the desired material from the waste material despite possible relaxation or other shifting or mispositioning of the material between the times of the cutting tool's first and second arrivals at the transition point.

16 Claims, 7 Drawing Sheets

METHOD AND APPARATUS FOR CUTTING SUCCESSIVE SEGMENTS OF SHEET MATERIAL WITH CUT CONTINUATION

FIELD OF THE INVENTION

This invention relates to a method and apparatus for cutting sheet material, such as fabrics for making clothing, upholstery or the like, spread either as a single sheet or a lay-up of sheets on a supporting surface wherein the material is cut in bites or segments by bringing in stepwise fashion successive lengthwise segments of the material to a cutting station and cutting each such segment at the cutting station before the material is advanced to bring the next segment to the station, and deals more particularly with improvements in such a method and apparatus for promoting a complete severing or separation of the cut pattern pieces from the adjacent waste material despite, because of the cutting station being of short length or for other reasons, the cutting of lines defining some pattern pieces having to be continued from one segment to another.

BACKGROUND OF THE INVENTION

The method and apparatus of this invention are ones relating to the cutting of pattern pieces from sheet material by means of a cutting tool moved along lines of cut defining the pattern pieces and wherein as the cutting tool is moved along a line of cut defining a pattern piece the cutting of that pattern piece is interrupted, the cutting tool is removed from cutting engagement with the material, and the material is advanced to bring a fresh segment of It to the cutting station before the cutting of that pattern piece is resumed.

After pattern pieces are cut from sheet material they are removed either by hand or by machine from the adjacent waste material. To allow an efficient separation it is quite important that the pattern pieces be cleanly cut from the Waste material and that no uncut strings, threads or connecting bridges exist between the pieces and the waste material. If such uncut features exist the involved pattern pieces may fail to be removed or expensive time consuming additional manual steps may have to be performed to complete the separation. One way to eliminate or at least reduce this problem is to cut each pattern piece with a single complete movement of the cutting tool along the periphery of each pattern piece without removing it from start to finish from cutting engagement with the material. Such "all-at-once" cutting of a pattern piece is not, however, always practical or possible and it may in many instances be desirable or necessary to interrupt the cutting of a pattern piece periphery with the cutting tool being withdrawn from cutting engagement with the material during such interruption. Unfortunately, the points at which these interruptions occur tend to be points at which incomplete cutting of the pattern pieces from the waste material may occur. If the periphery of a pattern piece includes a sharp corner it is known, to avoid uncut threads and as described in U.S. Pat. No. 4,133,233, to cause the tool as it approaches the corner point to overcut, that is to cut beyond the corner point, before being withdrawn from the material, rotated and brought back to the corner point for further cutting along the peripheral line away from the corner point.

Until recently, conveyorized cutting machines have been designed with cutting station lengths long enough to make it practical, if desired, to cut most or all of the wanted pattern pieces so that each is cut in a single continuous cycle of the cutting tool around its periphery. Typically, the cutting stations of these machines have been 13 to 20 feet or more in length. Since the cost of such a machine is directly proportional to its cutting station length a machine with a shorter cutting station can offer advantages of lower cost and of requiring less floor space. A shortened cutting station, however, may make it difficult or impossible to design cutting markers permitting each pattern piece to he cut all at once without shifting the material relative to the cutting station. That is, as the cutting station length is shortened it becomes more necessary to cut some pattern pieces in two or more stages with the work material being advanced between each stage.

As the cutting tool is moved along a line of cut in cutting engagement with the material it exerts forces on the material tending to displace or distort it from its neutral condition. The principle one of these forces is usually a forwardly directed force parallel to the line of forward movement of the cutting tool relative to the material, but significant lateral forces are also sometimes involved, particularly when cutting curved lines. When the tool is withdrawn from cutting engagement with the material, the forces exerted by the tool on the material are removed and the material relaxes. When the tool is returned to cutting engagement with the material to continue cutting along the same line, if it is inserted at exactly the same point as its point of withdrawal, or other point of furthest advance if different from the point of withdrawal, the now relaxed material is likely to have a slightly different disposition on the supporting surface than when the tool first arrived at that point, so that some threads or portions of the material may remain uncut as the cutting tool moves forwardly along the cut.

If the cutting tool is a knife reciprocated along a cutting axis extending generally perpendicularly to the material being cut, such knife generally has a sharpened forward cutting edge, an unsharpened rear edge parallel to the forward edge and an inclined sharpened lower edge terminating in a lowermost point. The lowermost point may be either in line with the rear edge or in line with the sharpened forward edge depending on the direction of inclination of the sharpened lower edge. If the lowermost tip of the knife is in line with the rear edge the sharpened lower edge tends to generally face forwardly toward the uncut material as the knife is advanced forwardly along the line of cut. The force exerted on the material by the knife also tends to push the material forwardly. If the knife is withdrawn from the material the material tends to relax rearwardly. If the knife is now immediately returned to the material at the point of withdrawal the generally forwardly facing inclined lower edge of the knife will tend to engage and cleanly cut the rearwardly displaced material since the inclined lower edge pushes such material forwardly against the adjacent body of uncut material to achieve a good cutting action, assuming the knife has a sufficient width to extend over all of the rearwardly displaced material and penetrates into the material forming the supporting surface for the work material. On the other hand, if the lower point of the knife is in alignment with the forward cutting edge the inclined lower sharpened edge faces generally rearwardly relative to the line of cut. If this blade is removed and reinserted at the same point into the material during a cutting operation the portion of the material which relaxes rearwardly during the removal of the knife is, after re-insertion of the knife, engaged by the rearwardly facing lower inclined surface which tends to urge the material it engages rearwardly toward the already cut portion of the line. Therefore, there is no back-up material tending to resist rearward movement of the relaxed material with the result that such relaxed material may not be completely cut, particularly if the inclined lower edge of the knife is somewhat dull.

As mentioned, in the case of conveyor type cutting machines or the like, where the material is cut one lengthwise segment at a time, it is often impractical, particularly if the cutting station is of relatively short length, to arrange the pattern pieces in a cutting marker so as to have each pattern piece contained within one segment permitting its being cut in one continuous cycle of the cutting tool. Instead, it is often desirable or necessary that at least some of the pattern pieces have portions falling into two or more adjacent segments. This means that one part of such a pattern piece is cut while a first segment of the material is positioned at the cutting station, and the cutting of the pattern piece is then interrupted and continued at a later time when another part is cut while the next adjacent segment is positioned at the cutting station. The points at which the periphery of such a pattern piece intersect the dividing line between adjacent segments of the material ar points at which clean cutting problems are likely to occur due to relaxation or other shifting or repositioning of the material taking place at such a point between the time of first cutting at that point and the time of later cutting at the same point.

The general object of the invention is therefore to provide a method and apparatus for overcoming clean cutting problems of the type mentioned above arising from the cutting of a first portion of a pattern piece periphery at one time and the cutting of the remaining portion of said periphery at a later time with the cutting tool being removed from cutting engagement with the material and the material being advanced relative to the cutting station between the cutting of the two involved periphery portions.

Other objects and advantages of the invention will be apparent from the following detailed description of preferred embodiments of the invention and from the accompanying drawings and claims.

SUMMARY OF THE INVENTION

The invention resides in a method and apparatus for cutting at least one line in work material wherein during the cutting of the line the cutting tool is moved forwardly along the line from a first point on the line to a second point on the line while in cutting engagement with the work material, the tool is withdrawn from cutting engagement with the material after it reaches the second point, the material is moved relative to the cutting station during the withdrawal of the knife to bring a fresh segment of the material to the cutting station, the tool is thereafter moved to a reengagement point located behind the second point on an already cut portion of the line, and the tool is then again moved into cutting engagement with the work material at the reengagement point and moved forwardly along the line of cut to and beyond the second point, so that if the tool is not exactly laterally aligned with the line when it is brought to the reengagement point it will inherently tend to move toward and into the already cut portion of the line as it is lowered into the material and/or moved along the already cut line portion, and so that it will also cut material which may have relaxed rearwardly from the second point The invention also resides in a method and apparatus for cutting the periphery of a pattern piece which extends to either side of a transverse dividing line separating adjacent material segments, wherein the cutting of the first portion of the pattern piece is started at or near one point A and ends at or near the other point B at which the dividing line crosses the pattern piece periphery when the first segment is positioned at the cutting station, and wherein the cutting of the second portion of the pattern piece periphery starts at or near said point B and ends at or near said point A when the second segment is positioned at the cutting station, with there being a retrace cutting of a portion of the line in the vicinity of both of said points A and B. That is, when the tool is brought back into cutting engagement with the material at point B it enters and retraces an already cut portion of the peripheral line and when the tool returns to point A at the end of the cutting of said peripheral line it enters and retraces another already cut portion of the line before being withdrawn from the material. The tool therefore at both of the points A and B tends to move toward and into an already cut portion of the line if it is initially slightly laterally displaced therefrom, and it also cuts any material which may have relaxed or otherwise slightly shifted in a direction along the peripheral line since the tool's previous appearance at the point in question. The invention also resides in other features of the method and apparatus defined by the appended claims.

DESCRIPTION OF THE PREFERRED EMBODIMENTS

The method and apparatus of this invention are useful in the cutting of sheet material and are applicable to various different kinds of cutting tools and cutting machines. For example, the cutting tool used for performing the actual cutting operation may be a reciprocating knife, an ultrasonically vibrated knife, a rotatable knife, a laser beam or a water jet. The cutting machine of which the cutting tool is a part may also, for example, be one wherein the cutting tool is moved either semi-automatically or automatically along lines of cut by a computer implemented control system using instructions derived from a set of marker data or other input data describing in X and Y coordinates the shape and arrangement of pattern pieces wanted from the sheet material.

Figure 1:
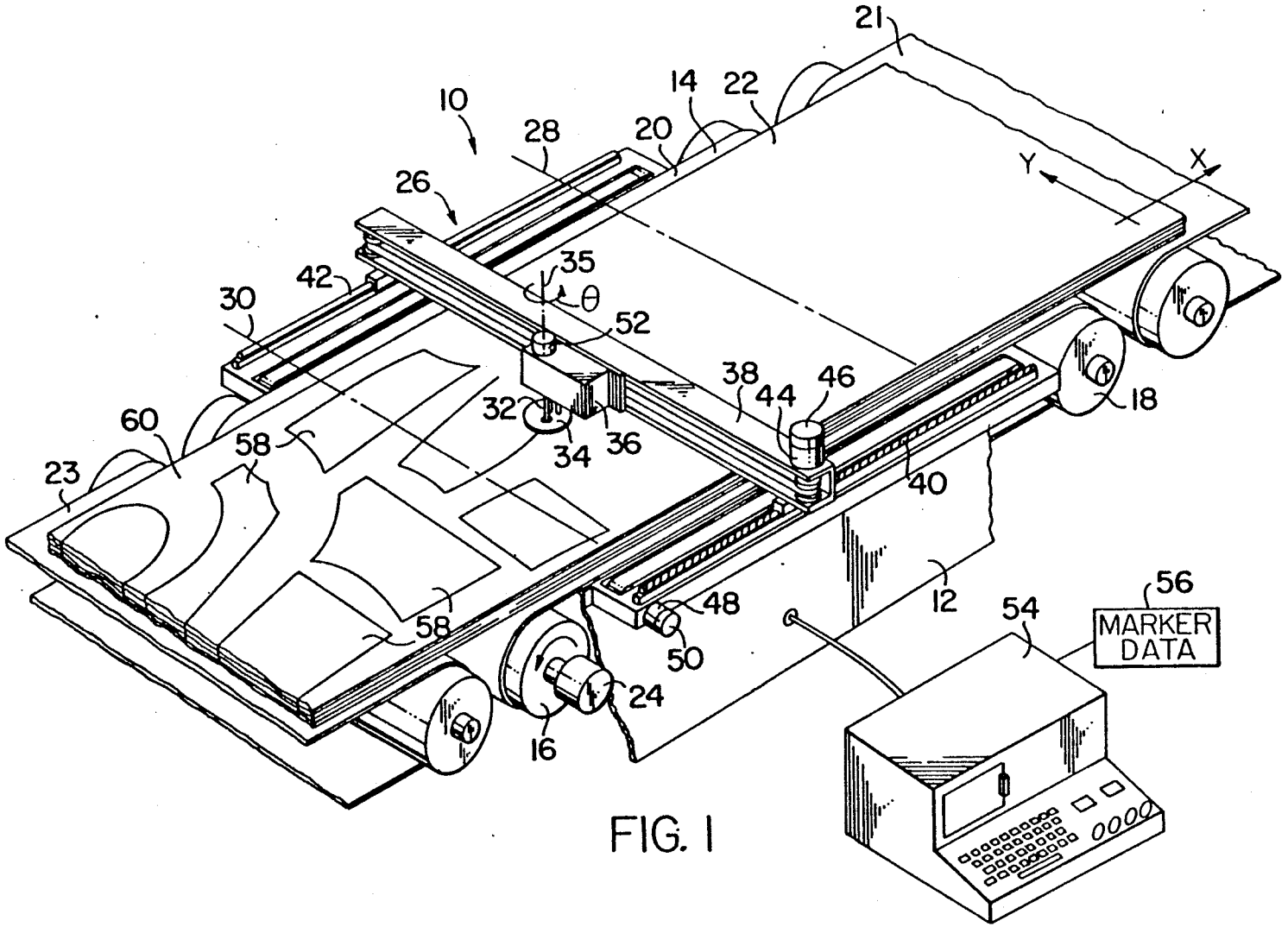
FIG. 1 is a perspective, somewhat schematic view of a cutting machine embodying the present invention.

Referring to FIG. 1, the invention is shown and described herein as embodied in an automatically controlled cutting machine 10 having a cutting station 26 of shorter length than the material to be cut and having a conveyor for supporting the work material a the cutting station and for moving it lengthwise relative to the frame of the machine to bring successive segments of the material to the cutting station. This machine 10 includes a stationary frame 12 and an endless belt-like conveyor member 14 trained about rolls 16 and 18. The conveyor member 14 may for example be of the type shown in U.S. Pat. No. 1,328,723 wherein the member is made up of a large number of transversely extending bristle block carrying grids or slats pivotally connected to one another and wherein the rolls 16 and 18 are of suitable sprocket-like shape for positive driving cooperation with the conveyor member. In any event, the conveyor member 14 provides, along its upper run, an upwardly facing supporting surface 20 for supporting work material 22 shown as a lay-up of a number of superimposed sheets of sheet material. The forward roll 16 is powered by a drive motor 24 which rotates the roll in the counterclockwise direction illustrated by the arrow to move the work material 22 along the illustrated X coordinate axis or toward the left as viewed in FIG. 1.

Various different means may be used with the machine 10 for assisting in bringing work material to and taking it from the cutting station 26. In the illustrated case of FIG. 1 these means include a feed conveyor 21 and a take-away conveyor 23 which may be of types well known in the art and which may be driven in unison with the conveyor member 14. In the alternative, the illustrated conveyor member 14 may be lengthened at either or both ends of the machine 10 to take the place of the separate feed conveyor 21 and/or the take-away conveyor 23.

The cutting station 26 has an effective range in the X coordinate direction defined by the limit lines 28 and 30, and has a range in the Y coordinate direction approximately equal to the width of the conveyor member 14 At the cutting station is a cutting tool 32 moveable in the X and Y coordinate directions over the full area of the cutting station to cut lines in the segment of work material positioned at the cutting station.

In the illustrated case the cutting tool 32 is a reciprocating knife, described in more detail hereinafter, cooperating with a presser foot 34 and reciprocated along a cutting axis 35 extending generally perpendicularly to the plane of the supporting surface 20. The cutting tool and the presser foot are carried by a cutter head 36, in turn carried by a main carriage 38, for movement relative thereto in the illustrated Y coordinate direction The main carriage straddles the conveyor member 14 and at each of its opposite ends is supported by suitable longitudinally extending guides 40, 42 for movement in the X coordinate direction relative to the frame 12. A Y drive means including a motor 44 and a Y encoder 46 drives the cutter head 36 in the Y coordinate direction relative to the main carriage 38; and an X drive means including a motor 48 and an X encoder 50 drives the main carriage 38 in the X coordinate direction. A reciprocating motor (not shown) in the cutter head drives the cutting tool 32 in its reciprocating motion, and another motor 33 (FIG. 8) rotates the cutting tool, under control of the controller 50, in the $\theta$ direction about the axis 35 to keep the tool facing forwardly along the line of cut. A solenoid 52 carried by the cutter head 36 is operable to move the cutter head frame 90 (FIG. 14), and therewith the cutting tool 32 and the presser foot 34, between a lowered position at which the cutter tool is in cutting engagement with the material 22 and a raised position at which the tool is out of cutting engagement with the material 22.

The machine 10 is controlled by a computer implemented controller 54 which supplies the necessary commands to the machine to operate the X and Y motors 48 and 44, the solenoid 52 and other parts of the machine so that the tool 32 is moved along desired lines of cut relative to the work material positioned at the cutting station 26. The control commands supplied by the controller 54 are generated in response to marker data, indicated representationally at 56, describing in terms of X and Y coordinates the shape and arrangement of pattern pieces 58 to be cut from the work material. A method and system for producing such marker data is, for example, described in U.S. Pat. No. 3,887,903. The data may be supplied either on line directly to a memory in the controller 54 or may be supplied to the controller pre-recorded on a tape, disc or other memory medium. In the operation of the machine 10, after a segment of the work material is positioned at the work station 26 the cutting tool is moved in the X and Y coordinate directions to cut lines in such segment, such lines usually being the peripheries of desired pattern pieces 58. After the segment is fully cut the cutting operation is interrupted, the drive motor 24 is operated to bring the next succeeding segment of work material to the work station and then the cutting tool 32 is operated again to cut lines in the fresh segment. Such segment-by-segment cutting is continued until all of the desired pattern pieces have been cut.

As explained previously, following the cutting of pattern pieces by the cutting tool 32 the pattern pieces are removed from the adjacent waste material 60 either by picking up the cut pattern pieces by hand or by using a mechanical separating means. To facilitate this separation it is essential that the pattern pieces be cleanly cut and separated from the waste material with there being no uncut fibers, strings or bridges connecting the pattern pieces to the waste material.

Figure 3:
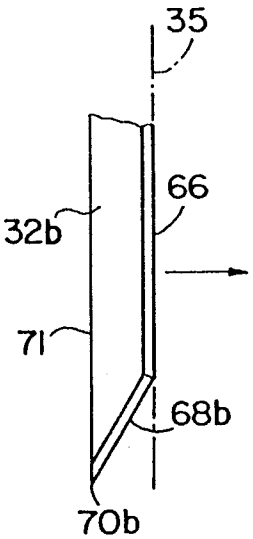
FIG. 3 is a side view of the lower end of another cutting knife usable with the machine of FIG. 1.
Figure 2:
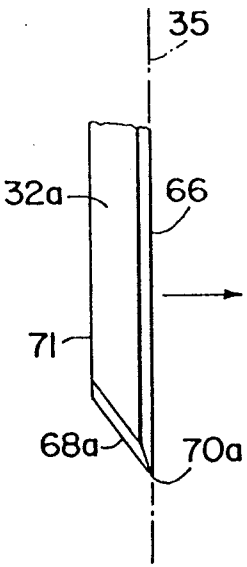
FIG. 2 is a side view of the lower end of a cutting knife usable with the machine of FIG. 1.

When the cutting tool is a knife, its shape has some influence on its ability to cut the relaxed material after being returned to a withdrawal point. For example, the knife 32 often has a shape either such as that of the knife **32*a* of FIG. 2 or that of the knife 32*b* of FIG. 3. In both of these figures the arrows indicate the direction of forward movement of the blade and the axis 35 is its axis of reciprocation. The knife 32*a* of FIG. 2 has a sharpened forward edge 66 and an inclined lower cutting edge 68*a* which faces generally rearwardly relative to the direction of forward movement of the knife so that the lowermost tip 70*a* of the knife is in alignment with the forward cutting edge 66**. On the other hand, the knife 32*b* of FIG. 3 has a sharpened forward cutting edge 66 and a sharpened lower cutting edge 68*b* inclined to face generally forwardly relative to the direction of movement of the knife so that the lowermost tip 70*h* of the knife is located in alignment with the rear edge 71 of the knife. If the knife 32*b* of FIG. 3 is re-inserted at a point of previous furthest advance the lower cutting edge 68*b* encounters any relaxed uncut material and tends to push such material forwardly against a mass of other uncut material so that the relaxed material becomes pressed with some force against the sharpened edge and is likely to be properly cut. Though the blade 32*b* does not tend to leave uncut fibers, assuming it has a sufficient width, it must penetrate more deeply in the supporting surface 20 than does the blade 32*a* of FIG. 3, in order to keep the forward cutting edge 66 of the blade from lifting above the supporting surface 20 while cutting. In some circumstances this can reduce the effective life of the supporting surface 20. On the other hand, when the blade 32*a* of FIG. 2 is re-inserted at a point of previous furthest advance, if the lower cutting edge 68*a* engages uncut relaxed material it tends to push such material rearwardly toward the already cut portion of the line. Therefore, no mass of other uncut material backs up the relaxed material with the result that the relaxed material may be merely pushed rearwardly by the edge 68*a* without being cut, particularly if the edge is somewhat dull. Therefore, when cutting with the knife 32*a* it is preferred that each reengagement point, as defined in the following discussion of the method of the invention, be located behind its associated point of furthest advance by a distance greater than the front to rear dimension of the knife.

Non-clean cutting tends to occur in segment-by-segment cutting of the work material when a pattern piece to be cut from the material has one part falling in one segment and another part falling in a following segment. Such a situation, and a related cutting procedure as known in the prior art, is shown, for example, in FIGS. 4 and 5. In those figures, the illustrated pattern piece 58 has one part located in a first segment 74 of the work material 22 and another part located in the following segment 76 of the work material. In advancing a fresh segment to the cutting station the material 22 is moved to the left parallel to the X coordinate direction as indicated by the arrow M. The line 73 is the dividing line between the illustrated segments 72 and 74; the line 75 is the dividing line between the segments 74 and 76; and the line 77 is the dividing line between the segment 76 and 78 Each segment has a length $L_s$ which for convenience of illustration is shown to be only slightly smaller than the effective length $L_{cs}$ of the cutting station 26 so that when a segment is positioned at the cutting station the two dividing lines (such as the lines 73 and 75 of FIG. 4) are each spaced slightly inboard from the adjacent limit lines 30 and 28 of the cutting station. In the cutting procedure of the prior art this is not however necessary and if desired the segment length $L_s$ may be equal to the cutting station length $L_{cs}$ with a segment positioned at the cutting station having its dividing or end limit lines collinear with the limit lines 30 and 28 of the cutting station.

Figure 4:
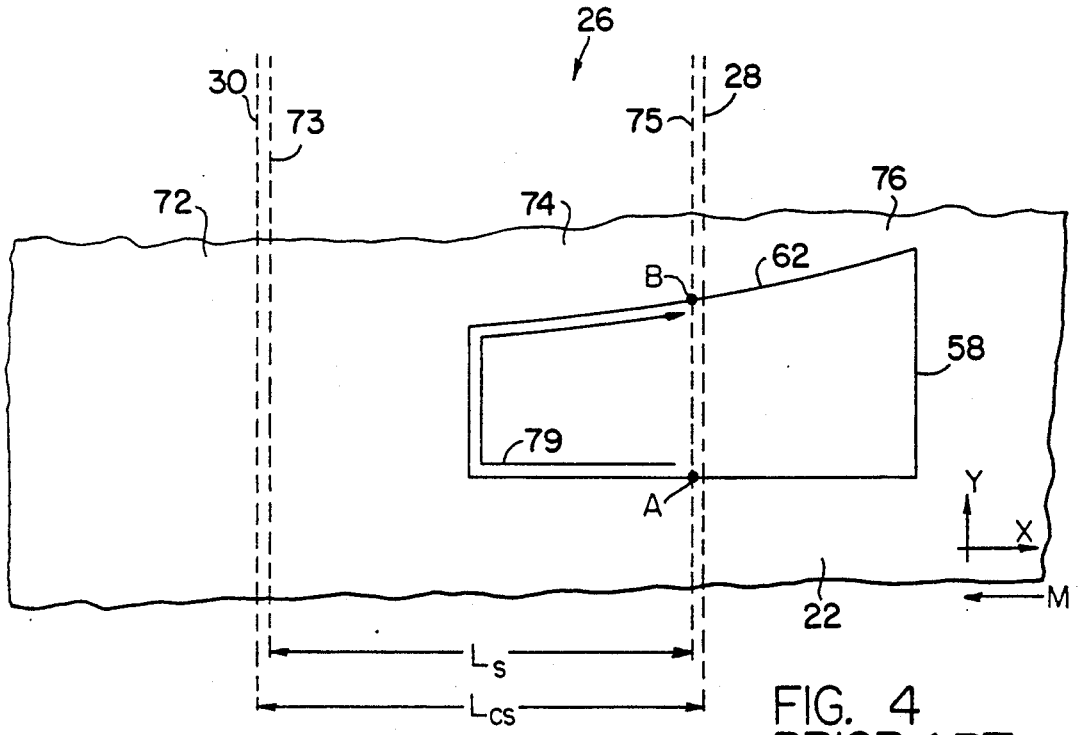
FIG. 4 PRIOR ART
FIGS. 4 and 5 are fragmentary plan views of a portion of sheet material cut by the machine of FIG. 1 and illustrating a known method of cutting.
Figure 5:
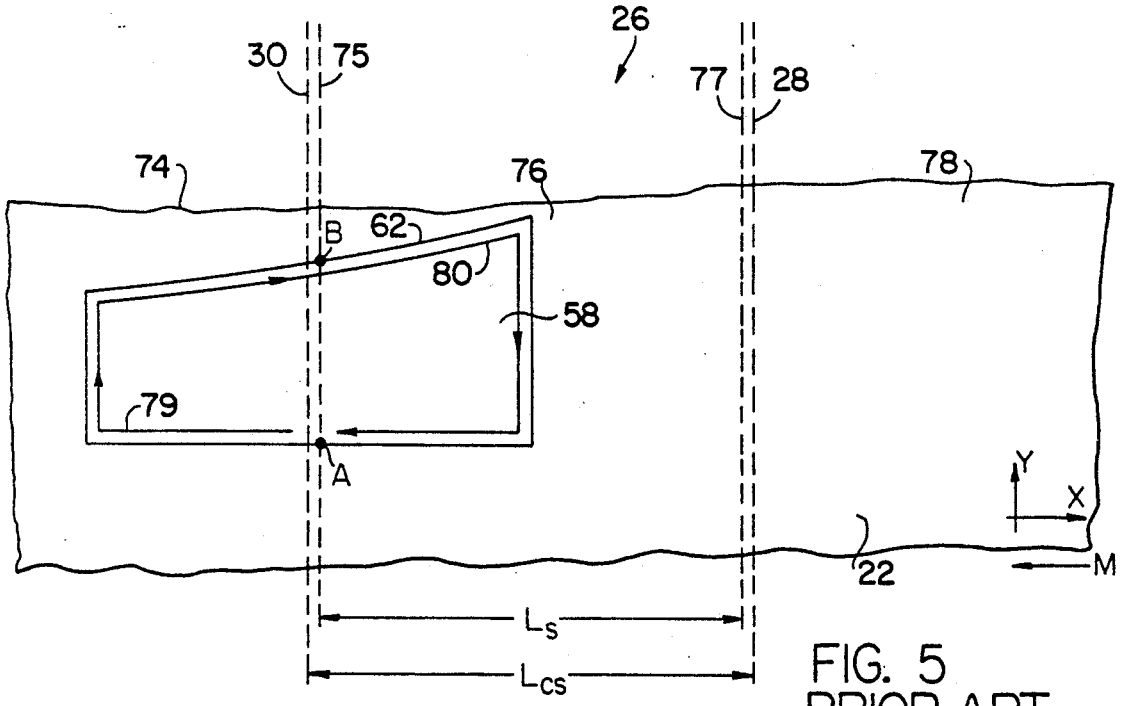
FIG. 5 PRIOR ART

In the conventional cutting of the illustrated pattern piece 58 of FIGS. 4 and 5 the part located in the segment 74 is cut while that segment is located at the cutting station 26 with the tool being inserted into the material at the point A on the peripheral line 62 and moved in cutting engagement with the material along the line 62, in the clockwise direction and as indicated generally by the arrowed line 79 to the point B. At the point B the tool is removed from cutting engagement with the material and may be used, if necessary, to cut other lines appearing in the segment 74 while that segment is still at the cutting station 26. When all of the lines in the segment 74 have been cut the material is advanced relative to the machine frame 12, by operation of the conveyor element 14, to bring the following segment 76 to the cutting station. At some time while the segment 76 is at the cutting station the cutting of the illustrated pattern piece 58 is continued and completed by re-engaging the cutting tool with the material at the point B and cutting along the remainder of the peripheral line 62 by moving the tool from the point B to the point A along the line 62, as indicated generally by the arrowed line 80.

Still with reference to FIG. 5, when the knife is withdrawn from the point B the material tends to relax rearwardly, and also some shifting or mispositioning of the material may take place as a result, of the fresh segment 76 having been advanced to the cutting station. Some possibility therefore exists for obtaining non-clean cutting when the knife is re-inserted at point B to finish the cutting of the pattern piece. Similarly when the cutting tool returns to the point A in FIG. 5 the material in the vicinity of that point may also he somewhat displaced due to relaxation, to shift or mispositioning during advancement, or to the force exerted by the tool on the material as it approaches the point A, creating some possibility for non-clean cutting at the point A.

In accordance with the invention, these problems are solved by providing a method and apparatus whereby the material is so out in the vicinity of both of the points A and B that when the tool returns to each of said points after a material advancement it enters and retraces an already cut portion of the line 62. This retrace cutting at both of the points A and B is implemented by the controller 54 under the control of its software program. The actual performance of the retrace cutting may be achieved in a number of more detailed ways as illustrated by FIGS. 6 to 13.

Figure 6:
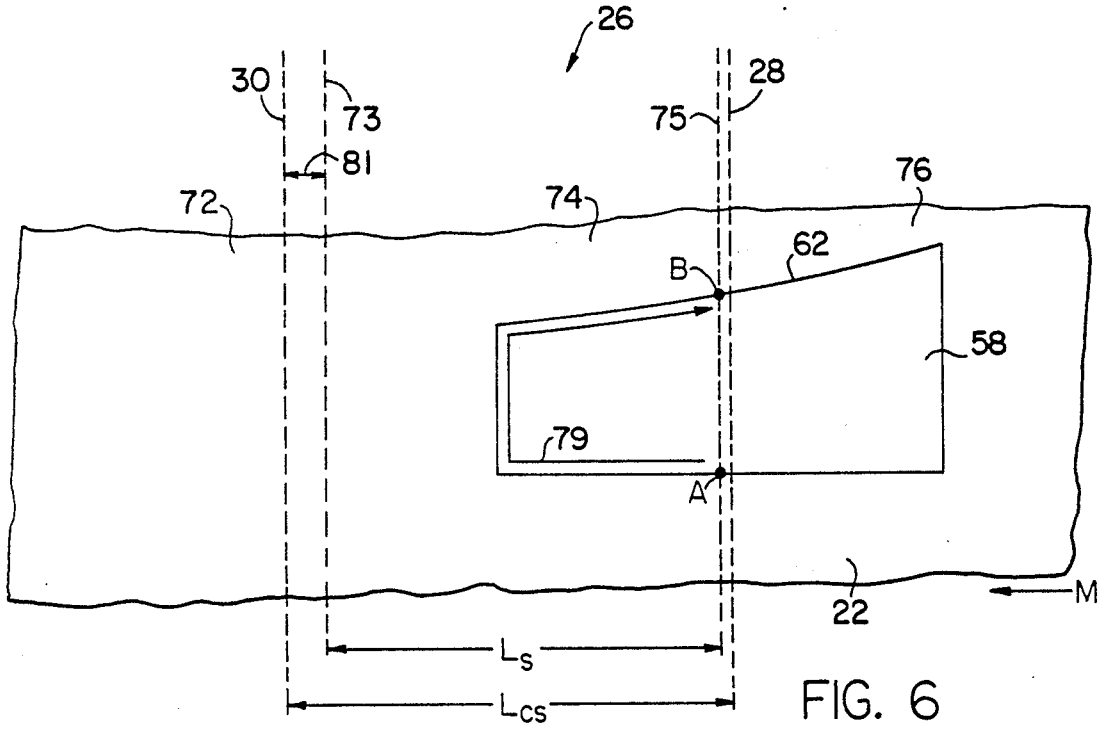
FIGS. 6 and 7 are fragmentary plan views similar to FIGS. 4 and 5 illustrating one embodiment of the method of the invention.
Figure 7:
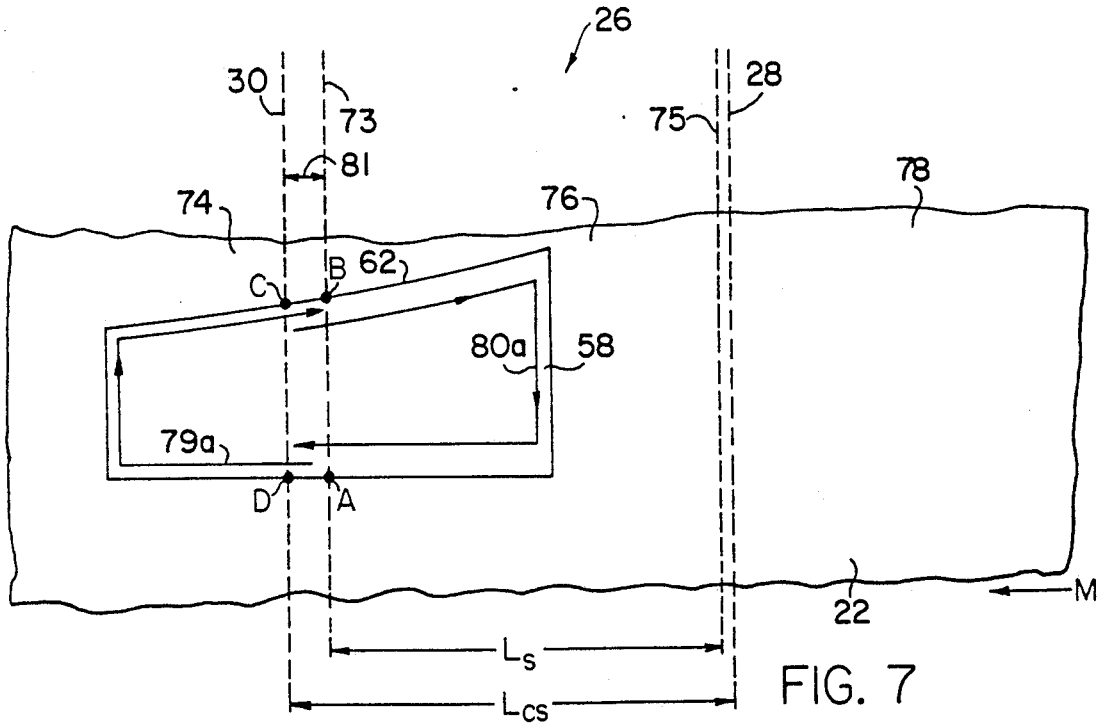

FIGS. 6 and 7 show one embodiment of the method of the invention wherein the computer program is set up to cause the extra cutting needed for the achievement of the retrace cutting to occur during the cutting of the trailing portion of the pattern piece 58. Referring to these figures, it will first be observed that the length $L_s$ of each segment 74, 76, is less than the length $L_{cs}$ of the cutting station and that when a segment is positioned at the cutting station 26 its left dividing or end defining line, 73 in FIG. 6 or 75 in FIG. 7, is spaced to the right of the left limit line 30 of the cutting station to provide a retrace zone 81 permitting the extra cutting hereinafter described. The length of this retrace zone 81 may vary but preferably preferably it is within the range of 1/16 inch to 1 inch, and more approximately ½ inch. In FIGS. 6 and 7 the right-hand dividing or end defining line, 75 in FIG. 6 and 77 in FIG. 7, of the segment positioned at the cutting station is for clarity of illustration shown slightly spaced from the right limit line 28 of the cutting station, but in actuality these two lines may be and are preferably located very close to or collinear with one another.

In the method illustrated in FIGS. 6 and 7 when the segment 74 is positioned at the cutting station 26, as in FIG. 6, the left-hand or leading part of the pattern piece 58 is cut by inserting the cutting tool into cutting engagement with the material 22 at the point A and then cutting in the clockwise direction along the peripheral line 62 to the point B, as indicated by the arrowed line 79, the points A and B being the points at which the peripheral line 62 intersects the segment dividing line 75. The cutting tool is then withdrawn from the material and the material is advanced in the direction of the arrow M to bring the next segment 76 to the cutting station 26, as shown in FIG. 7. The cutting tool is then moved to a reengagement point C on the peripheral line 62 spaced rearwardly from the point B. The tool is then brought back into cutting engagement with the material at the point C and moved forwardly from point C along the line 62 to and beyond the point B and toward the point A as indicated by the arrowed line 80*a*. As the tool reaches the point A it continues on beyond the point A to the point D before being withdrawn from cutting engagement with the material.

Figure 15:
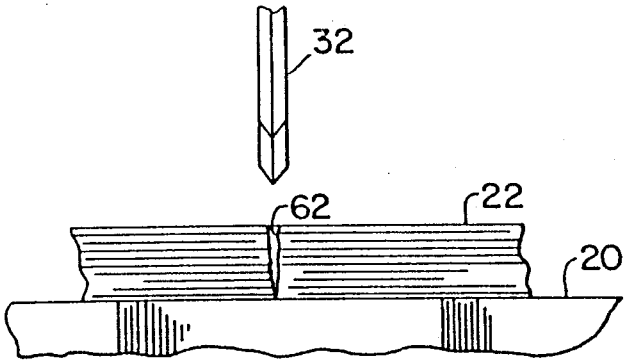
FIG. 15 is a fragmentary vertical sectional view showing the cutting tool of the machine of FIG. 1 positioned at a reengagement point and above an already cut portion of a line cut in the work material

From the foregoing discussion of FIGS. 6 and 7 it will appreciated that the cutting of the pattern piece 58 is retraced in the vicinities of both of the points A and B That is, when the tool is moved to the point C to begin cutting of the trailing portion of the pattern piece it is associated with an already cut portion of the line 62. As the tool is moved downwardly, from the position shown in FIG. 15, into cutting engagement with the material 22, if the tool is slightly laterally displaced from the already cut portion of the line 62 it will tend to move into the already cut portion because of the tapered shape of the lower end of the knife 32 and also because of the tendency of the tool to move to the already cut portion of the line as it is moved forwardly along such portion. Similarly, when the tool returns to the point A it retraces an already cut portion of the line by continuing to be moved to the point D. If the tool is slightly laterally displaced from such already cut line when it reaches the point A it will tend to move to such already cut portion as it advances from point A to point D. In FIG. 7 the points C and D have been shown as being points at which the left-hand cutting station limit line 30 intersects the peripheral line 62. This however, is not necessary to the invention, and if desired the points C and D could be spaced to the left of the points B and A by some distance less than the length of the retrace zone 81. If desired these spacings may also be variable and/or may be automatically set by the computer in dependence on one or more parameters of the cutting process.

Figure 8:
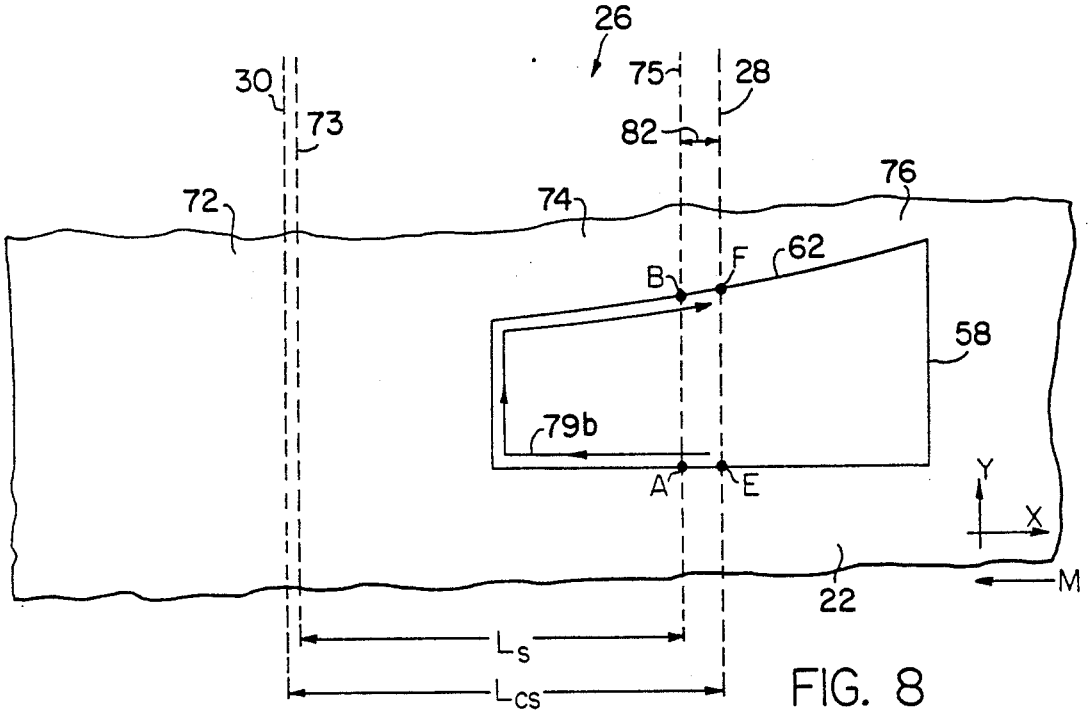
FIGS. 8 and 9 are fragmentary plan views similar to FIGS. 4 and 5 illustrating another embodiment of the method of the invention.
Figure 9:
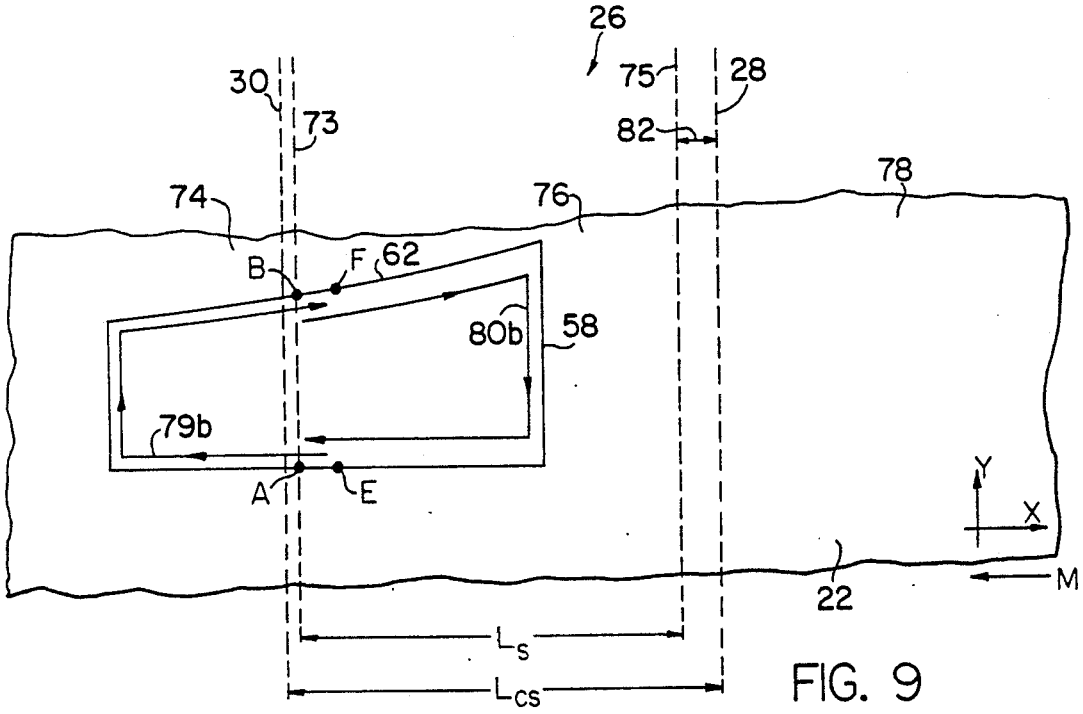

FIGS. 8 and 9 show a method generally similar to that of FIGS. 6 and 7 except that a retrace zone 82 is provided in place of the retrace zone 81 of FIGS. 6 and 7 with the retrace zone 82 being located adjacent the right-hand limit line 28 of the cutting zone 26. In this illustrated method the left-hand or leading part of the pattern piece 58 is cut, as shown in FIG. 8, by inserting the cutting tool into cutting engagement with the material 22 at a point E located on the peripheral line 62 in advance of the nominal starting point A. The tool is then moved in cutting engagement with the material 22 in the clockwise direction, and as illustrated by the arrowed line 79*b*, from the point E to and beyond the point A to the nominal stopping point B. Instead of withdrawing the tool at the point B, however, its advancement in cutting engagement with the material is continued beyond the point B to the point F. The tool is then withdrawn from the material and the material advanced to the position shown in FIG. 9 with the segment 76 positioned at the cutting station 26. The trailing or right-hand portion of the pattern piece 58 is then cut by reintroducing the knife into cutting engagement with the material at the point B and cutting clockwise along the line 62, as indicated by the arrowed line 80*b*, until reaching the point A. From FIG. 9 it will therefore be appreciated that substantially the same retracing of portions of the line 62 occurs in the vicinity of the points A and B as in the case of the method illustrated in FIGS. 6 and 7 with the same desirable results as described in connection with FIGS. 6 and 7.

The method of FIGS. 6 and 7 and the method of FIGS. 8 and 9 both have the advantage that only a single retrace zone 81 or 82 need be provided at one or the other end of the cutting station. If desired, however, the invention may also be practiced by providing such retrace zones at both ends of the cutting station. One such method is illustrated in FIGS. 10 and 11 and another in FIGS. 12 and 13.

Figure 10:
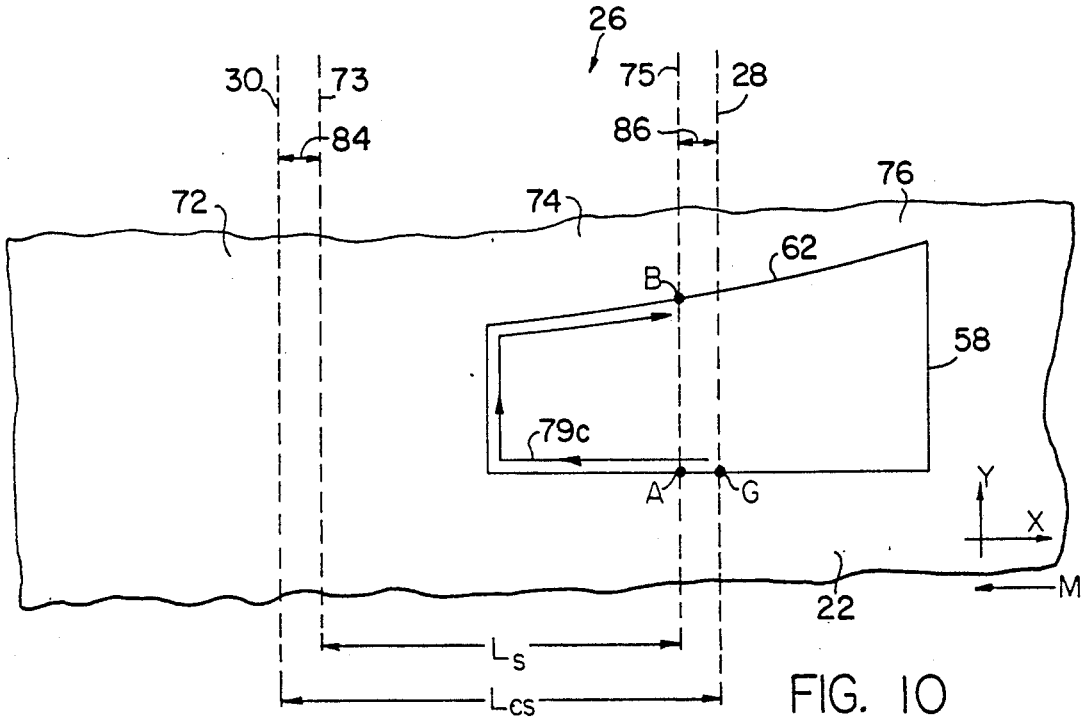
FIGS. 10 and 11 are views similar to FIGS. 4 and 5 illustrating a further embodiment of the method of the invention.
Figure 11:
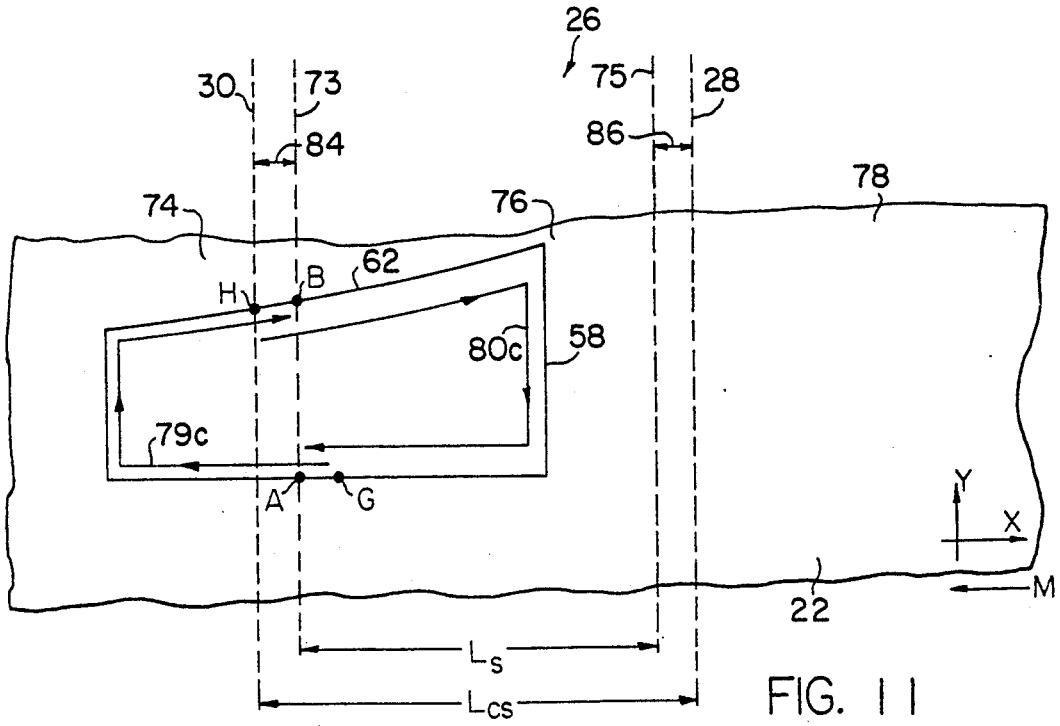

Referring to FIGS. 10 and 11 the arrangement shown is generally similar to that of FIGS. 6 and 7 except for there being two retrace zones 84 and 86 in place of the single retrace zone 81 of FIGS. 6 and 7 when cutting the left-hand or leading portion of the pattern piece 58, in accordance with the method of FIGS. 10 and 11, the cutting tool, as shown in FIG, 10, is first moved into cutting engagement with the material at a point G on the line 62 spaced rearwardly from the point A. The cutting tool is then moved forwardly in the clockwise direction, as indicated by the arrowed line 79*c*, from the point G to and beyond the point A to the point P. The tool is then withdrawn from cutting engagement with the material and the material advanced to the position shown in FIG. 11. The right-hand or trailing portion of the pattern piece 58 is then cut by inserting the tool into cutting engagement with the material at the point H, and the tool is then moved forwardly along the line 62, as shown by the arrowed line 80*c*, to and beyond the point B to the point A. Again it will be apparent from FIG. 11 that retrace cutting occurs in the vicinity of both of the points A and B in much the same fashion and with the same results as in the method of FIGS. 6 and 7.

Figure 12:
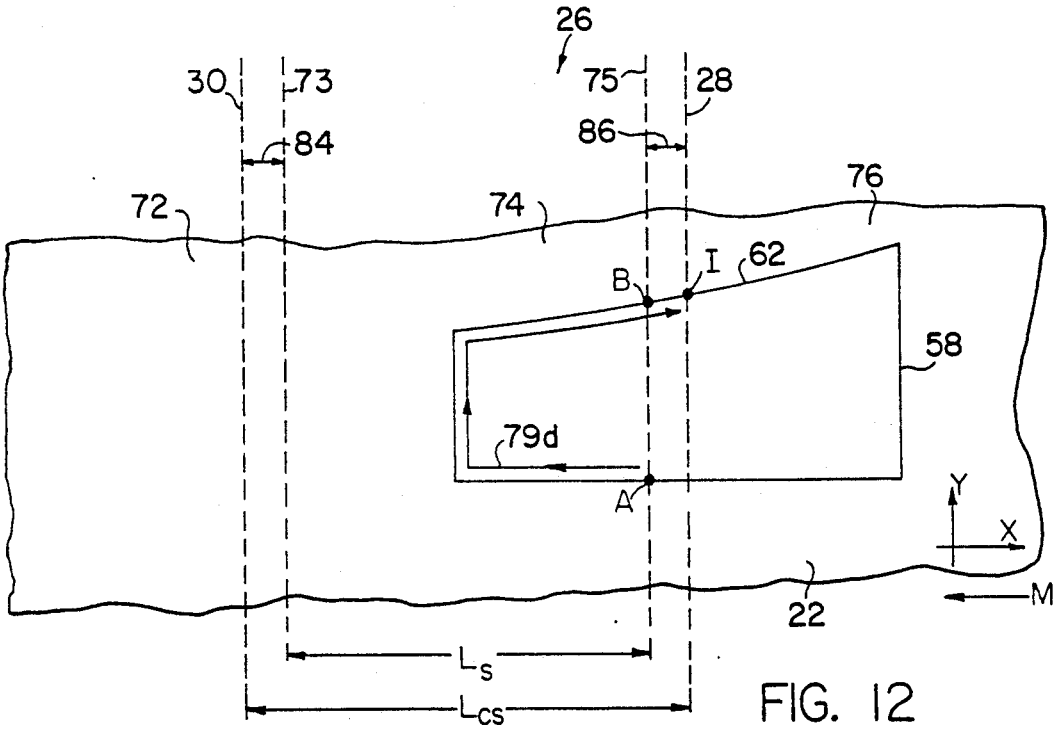
FIGS. 12 and 13 are views similar to FIGS. 4 and 5 illustrating yet another embodiment of the method of the invention.
Figure 13:
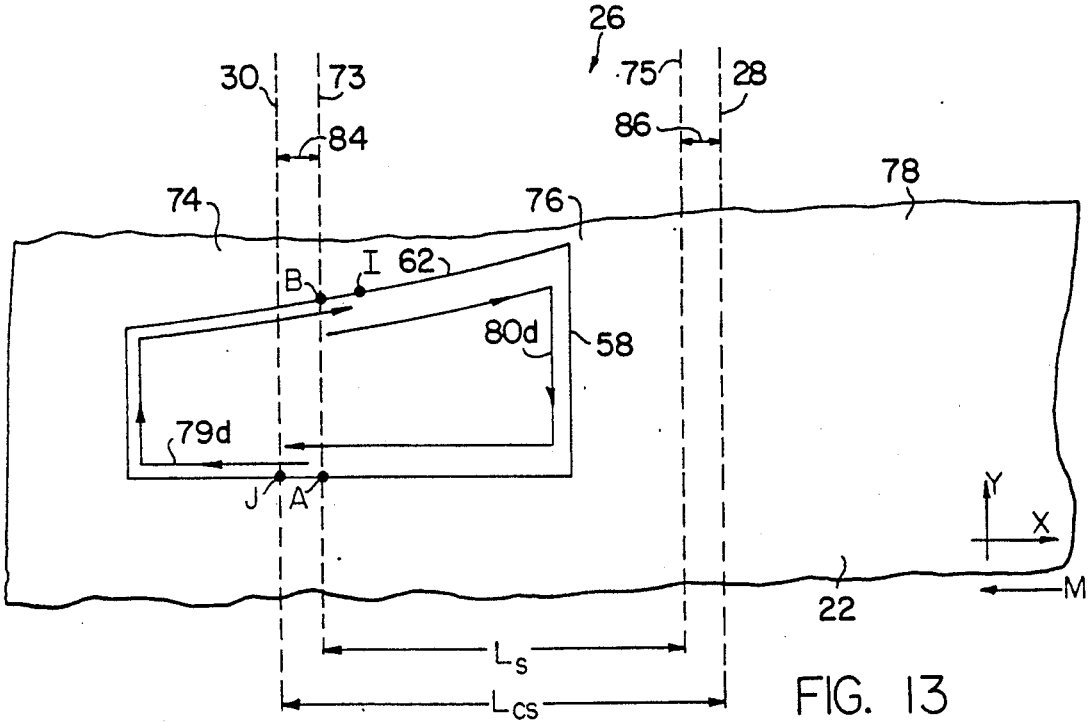

In the method of FIGS. 12 and 13 the same two retrace zones 84 and 86 are provided adjacent the ends of the cutting station as in FIGS. 10 and 11. In the cutting of the left-hand or leading portion of the pattern piece 58, as shown in FIG. 12, the cutting tool is inserted into cutting engagement with the material 22 at the point A and then moved forwardly in cutting engagement with the material along the line 62, as indicated generally by the arrowed line 79*d*, to the point B. Then, instead of the tool being withdrawn at the point 8, it is continued in cutting engagement with the material to the point 1. The tool is then withdrawn from cutting engagement with the material at the point 1 and the material 22 advanced to the position shown in FIG. 13. The tool is then reengaged with the material at the point B and moved in cutting engagement with the material along the line 62, as shown by the arrowed line 80*d*, from the point B to the point A. The tool, however, is not withdrawn from the material at the point A but instead is maintained in cutting engagement with the material and moved forwardly beyond the point A to the point J at which point the tool is withdrawn. From consideration of FIG. 13 it will be apparent that a retracing of the line of cut in the vicinity of both of the points A and B occurs with substantially the same benefits as discussed in more detail above in connection with FIGS. 6 and 7.

In comparing the known cutting method of FIGS. 4 and 5 with the cutting method of the invention as illustrated in FIGS. 6 to 13 it will be seen that the method of the invention provides for extra cuts in addition to the cuts of FIGS. 4 and 5 to achieve retrace cutting in the vicinity of the points A and B at which a pattern piece periphery continues from one segment to another. In FIG. 7 the extra cuts are the cut from point C to point B and the cut from point A to point D while following the path indicated by the arrowed line 80*a*. In FIG. 9 the extra cuts are the cut from the point E to the point A and the cut from the point B to the point F while cutting along the path indicated by the arrowed line 79*h*. In FIG. 11 the extra cuts are the cut from the point G to the point A while cutting the path indicated by the arrowed line 79*c* and the cut from the point H to the point H while cutting along the path indicated by the arrowed 80*c*. In FIG. 13 the extra cuts are the cut from the point B to the point I while cutting along the path indicated by the arrowed line 79*d* and the cut from the point A to the point J while cutting along the path indicated by the arrowed line 80*d*.

The extra cuts referred to in the preceding paragraph may be included in the marker data 56 supplied to the controller 54. That is, in preparing the marker data the places at which extra cuts are wanted may be recognized and instructions for the execution of the extra cuts by the machine may be added to the other instructions making up the marker data so that in direct response to the marker data the extra cuts are executed along with the basic cuts defining the pattern piece peripheries. This procedure, however, requires that the marker data be initially prepared, or be later reprocessed to include instructions for the extra cuts. As an alternative to this and to avoid having to include the extra cut instructions in the marker data, the computer of the controller 54 can be programmed to operate with marker data 56 not including extra cut instructions and to generate itself the needed extra cut instructions. That is, the computer of the controller 54 in this instance will determine when and where extra cuts are required and will generate appropriate instructions causing the machine 10 to execute them. Preferably as each segment of marker is processed the controller 54 will retain in memory the portion of the trailing edge of the marker segment defining the extra cuts. Then, when the material is advanced the controller will add the extra cuts to the leading edge of the next segment to be cut. This will then be repeated for each segment.

Figure 14:
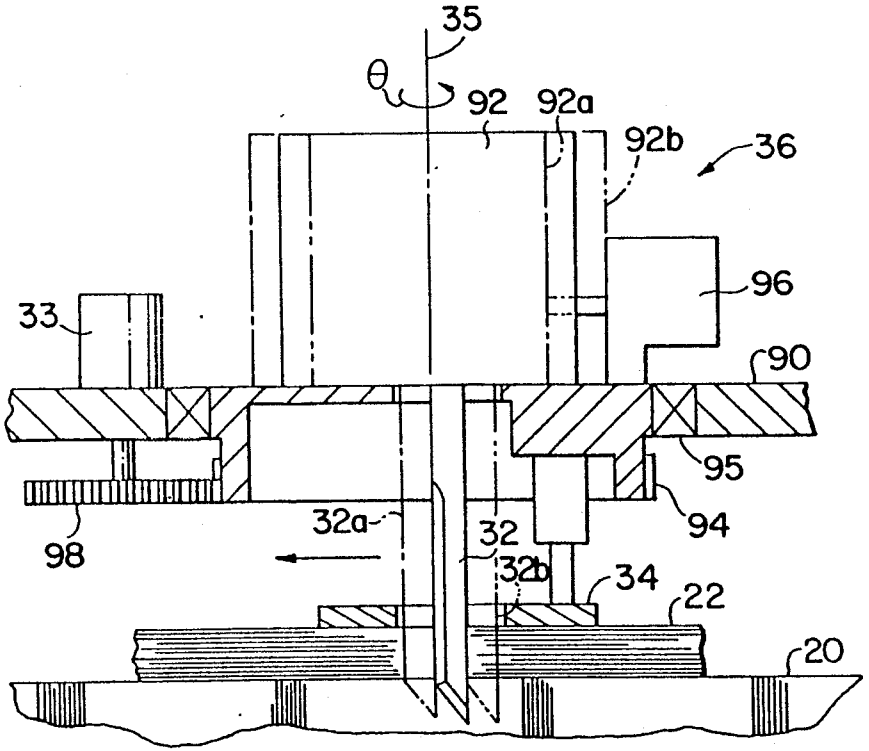
FIG. 14 is a vertical sectional view through the cutter of FIG. 1.

The extra cuts described in the preceding paragraphs may be cut by maintaining the cutting axis 35 of the tool at all times fixed in the X and Y coordinate directions relative to the frame of the cutter head 36 and by having the controller programmed to perform the extra cuts by moving the frame of the cutter head 36 relative to the fixed frame 12 of the machine to move the tool 32 along the entirety of the lines of cut indicated by the arrowed lines 79*a*, 80*a*, 79*b*, 80*b*, 79*c*, 80*c*, 79*d* and 80*d*. An alternative way of executing the extra cuts of FIGS. 6 to 13 is to move the frame of the cutter head 36 relative to the frame 12 of the machine to execute the cutting of the major portions of the lines of cut and to make the extra cuts by holding the frame of the cutter head 36 stationary relative to the machine frame 12 moving the cutting axis of the tool relative to the cutter head frame. An apparatus for doing this is shown in FIG. 14 wherein the cutter head 36 has a frame 90 moved in the X and Y coordinate directions relative to the machine frame 12 by the motors 48 and 44 of FIG. 1. The knife reciprocating mechanism 92 is mounted on a generally cylindrical member 94 supported by a bearing 95 for rotation about the theta axis which is collinear with the cutting and reciprocation axis 35 of the knife when the reciprocating mechanism 92 is in the illustrated full line position. A motor 33 drivingly engages the member 94 through a gear 98 to effect the theta rotation used to maintain the knife 32 tangent to the line of cut. The reciprocating mechanism 92 is supported on the member 94 for back and forth movement parallel to the front to rear direction of the knife 32 between a normal position shown by the solid lines, an advanced position shown by the broken lines 2*a*, and a retracted position shown by the broken lines 92*b*. The knife 32 moves with the reciprocating mechanism 92 relative to the member 94 so as to have a normal position shown by the full lines when the reciprocating mechanism is in its normal position, an advance position, as shown by the broken lines 32*a*, when the reciprocating mechanism is in its advanced position and a retracted position, as shown by the broken lines 32*b*, when the reciprocating mechanism is in its retracted position. A solenoid 96 carried by the member 94 is operable to move the reciprocating mechanism 92 between its normal and its advanced and retracted positions. Usually the reciprocating mechanism 92 is kept in its normal position and is used in that position to cut the major portions of the lines of cut, and it is moved between such normal position and the advanced or retracted positions to execute the extra cuts. For example, in performing the cutting method of FIGS. 6 and 7 the knife in its normal position may be used to cut along the path 79*a* from point A to point B. The knife is then raised from cutting engagement with the material and the material advanced to the position of FIG. 7. The cutter head frame is then moved to reposition the knife at the point B. while the cutter head frame 90 is held stationary the solenoid 96 is operated to shift the reciprocating mechanism 92 and knife 32 to their retracted positions to bring the knife to the point C. The knife is then engaged with the material and moved in cutting engagement with the material from the point C to the point B by operating the solenoid 96 to return the reciprocating mechanism 92 and the knife 32 to their normal positions. The cutting head frame is then moved along the arrowed path 90*a* from the point B to the point A. Upon reaching the point A the movement of the cutter head frame 90 is stopped, the frame is held stationary, and the solenoid 96 is operated to move the reciprocating mechanism 92 and knife 32 forwardly to their advanced positions to cut from the point A to the point D. Similar movements of the reciprocating mechanism 92 on the member 94 while the frame 90 is held stationary relative to the machine frame 12 can be used to execute the extra cuts illustrated in FIGS. 8 to 13.

I claim:

1. A method of cutting a line in work material consisting of at least one sheet of sheets of sheet material, said method comprising the steps of:

providing a cutting machine having a machine frame, a cutting station fixed relative to said machine frame, and a cutting tool movable relative to said machine frame at said cutting station in X and Y coordinate directions to cut lines in material located at said cutting station, providing a quantity of the work material having a length in said X coordinate direction greater than the length of said cutting station in said X coordinate direction, defining a line to be cut in said work material, positioning said work material so that a portion of said line is located at said cutting station, moving a cutting tool forwardly along said line from a first point on said line to a second point on said line while in cutting engagement with said work material, after said cutting tool reaches said second point withdrawing said tool from cutting engagement with said work material, advancing said material in said X coordinate direction relative to said machine frame to bring another portion of said line to said cutting station, moving said tool to a reengagement point located on said line in the vicinity of said second point and located between said first and second points with said tool being held out of cutting engagement with said work material when it arrives at said reengagement point, moving said tool into cutting engagement with said work material at said reengagement point, and thereafter again moving said tool forwardly along said line in cutting engagement with said work material from said reengagement point to and beyond said second point so that as said tool moves from said reengagement point to said second point it retraces an already cut portion of said line.

2. A method of cutting a line in work material as defined in claim 1 and further including:

said cutting tool having a cutting axis extending generally perpendicularly to said X and Y coordinate directions and said cutting tool being part of a cutter head having a frame, said step of moving said cutting tool forwardly along said line from a first point on said line to a second point on said line being performed by maintaining said cutting axis fixed relative to said cutter head frame and moving said cutter head frame relative to said machine frame in said X and Y coordinate directions, said step of moving said tool to said reengagement point being performed by maintaining said cutting axis fixed relative to said cutter head frame and moving said cutter head frame to bring said cutting axis to said reengagement point, and said step of moving said tool forwardly along said line in cutting engagement with said work material from said reengagement point to and beyond said second point being performed by maintaining said cutting axis fixed relative to said cutter head frame and moving said cutter head frame relative to said machine frame in said X and Y coordinate directions.

3. A method of cutting a line in work material as defined in claim 1 and further including, said cutting tool having a cutting axis extending generally perpendicularly to said X and Y coordinate directions and said cutting tool being part of a cutter head having a frame and a means for moving said cutting axis relative to said cutter head frame, said step of moving said cutting tool forwardly along said line from a first point on said line to a second point on said line being performed by maintaining said cutting axis fixed relative to said cutter head frame and moving said cutter head frame relative to said machine frame in said X and Y coordinate directions, said step of moving said tool to a reengagement point being performed by moving said cutter head frame to the vicinity of said second point, and positioning said cutting axis relative to said cutter head frame to bring said cutting axis to said reengagement point, and said step of moving said tool forwardly from said reengagement point to and beyond said second point being performed by first moving said cutting axis relative to said cutter head frame to move said tool in cutting engagement with said work material from said reengagement point to said second point while said cutter head frame is held stationary relative to said machine frame, and then holding said cutting axis fixed relative to said cutter head frame and moving said cutter head frame relative to said machine frame to cut said line beyond said second point.

4. A method of cutting work material as defined in claim 1 further including:

said cutting tool being a knife reciprocated along an axis of reciprocation extending generally perpendicularly to said X and Y coordinate directions while in cutting engagement with said work material.

5. A method of cutting work material as defined in claim 4 further including:

said reengagement point being spaced from said second point by a distance of between 1/16 inch and 1 inch.

6. A method of cutting work material as defined in claim 5 further including:

said reengagement point being spaced from said second point by a distance of approximately ½ inch.

7. A method of cutting work material as defined in claim 5 further including:

said reengagement point being spaced from said second point by a distance greater than the front to rear dimensions of said knife.

8. A method of cutting work material as defined in claim 1 and further including:

said line being a closed line defining the periphery of at least one pattern piece to be cut from said work material, after performing said step of again moving said tool forwardly along said line in cutting engagement with said work material from said reengagement point to and beyond said second point continuing to move said cutting tool along said line in cutting engagement with said work material until returning to said first point, and after returning to said first point continuing to move said tool forwardly along said line beyond said first point in cutting engagement with said work material to a final point located on said line so that in moving between said first point and said final point said tool retraces an already cut portion of said line.

9. A method of cutting work material as defined in claim 8 and further including:

said cutting tool having a cutting axis extending generally perpendicularly to said X and Y coordinate directions and said cutting tool being part of a cutter head having a frame, said step of moving said cutting tool forwardly along said line from a first point on said line to a second point on said line being performed by maintaining said cutting axis fixed relative to said cutter head frame and moving said cutter head frame relative to said machine frame in said X and Y coordinate directions, said step of moving said tool to said reengagement point being performed by maintaining said cutting axis fixed relative to said cutter head frame and moving said cutter head frame to bring said cutting axis to said reengagement point, said step of moving said tool forwardly along said line in cutting engagement with said work material from said reengagement point to and beyond said second point being performed by maintaining said cutting axis fixed relative to said cutter head frame and moving said cutter head frame relative to said machine frame in said X and Y coordinate directions, said step of continuing to move said cutting tool along said line in cutting engagement with said work material until returning to said first point being performed by maintaining said cutting axis fixed relative to said cutter head frame and moving said cutter head frame relative to said machine frame in said X and Y coordinate directions, and said step of continuing to move said tool forwardly along said line beyond said first point in cutting engagement with said work material to a final point being performed by maintaining said cutting axis fixed relative to said cutter head frame and moving said cutter head frame relative to said machine frame in said X and Y coordinate directions.

10. A method of cutting work material as defined in claim 8 and further including, said cutting tool having a cutting axis extending generally perpendicularly to said X and Y coordinate directions and said cutting tool being part of a cutter head having a frame and a means for moving said cutting axis relative to said cutter head frame, said step of moving said cutting tool forwardly along said line from a first point on said line to a second point on said line being performed by maintaining said cutting axis fixed relative to said cutter head frame and moving said cutter head frame relative to said machine frame in said X and Y coordinate directions, said step of moving said tool to a reengagement point being performed by moving said cutter head frame to the vicinity of said second point, and positioning said cutting axis relative to said cutter head frame to bring said cutting axis to said reengagement point, said step of moving said tool forwardly from said reengagement point to and beyond said second point being performed by moving said cutting axis relative to said cutter head frame to move said tool in cutting engagement with said work material from said reengagement point to said second point while said cutter head frame is held stationary relative to said machine frame, and then holding said cutting axis fixed relative to said cutter head frame and moving said cutter head frame relative to said machine frame to cut said line beyond said second point until it returns to said first point, and said step of moving said cutting tool forwardly between said first point and said final point being performed by holding said cutter head frame stationary relative to said machine frame and moving said cutting axis forwardly relative to said cutter head frame.

11. A method for cutting at least one pattern piece from at least one sheet of work material, said method comprising the steps of:

providing a cutting machine having a machine frame, a cutting station fixed relative to said machine frame, and a cutting tool movable relative to said machine frame at said cutting station in X and Y coordinate directions to cut lines in material located at said cutting station, providing a quantity of the work material having a length in said X coordinate direction greater than the length of said cutting station in said X coordinate direction, defining a line to be cut in said work material which line describes the periphery of a pattern piece having a portion located in a first segment of said material and another portion located in an adjacent second segment of said material which first and second segments are separated from one another by a dividing line, positioning said work material so that said first segment is located at said cutting station, moving said cutting tool forwardly in cutting engagement with said work material along said line from a first point at which said peripheral line intersects said dividing line to a second point at which said peripheral line intersects said dividing line, after said cutting tool reaches said second point withdrawing said tool from cutting engagement with said work material, advancing said material in said X coordinate direction relative to said machine frame to bring said second portion of said material to said cutting station, moving said tool to a reengagement point located on said peripheral line in the vicinity of said second point located behind said second point with said tool being held out of cutting engagement with said work material when it arrives at said reengagement point, moving said tool into cutting engagement with said work material at said reengagement point, thereafter again moving said tool forwardly along said line in cutting engagement with said work material from said reengagement point to said second point so that as the tool moves from said reengagement point to said second point it retraces a already cut portion of said line, continuing to move said tool forwardly along said line from said second point until it returns to said first point, and then continuing to move said tool forwardly along said line beyond said first point so as to retrace another previously cut portion of said line before being withdrawn from cutting engagement with said material.

12. A method of cutting work material as defined in claim 11 further including:

said cutting tool having a cutting axis extending generally perpendicularly to said X and Y coordinate directions and said cutting tool being part of a cutter head having a frame and a means for moving said cutting axis relative to said cutter head frame, and some of the cutting of said peripheral line being performed by holding said cutting axis fixed relative to said cutter head frame and moving said cutter head frame relative to said machine frame in said X and Y coordinate directions, and cutting of other portions of said line being performed by holding said cutter head frame fixed relative to said machine frame and moving said cutting axis relative to said cutter head frame.

13. A method of cutting pattern pieces in work material consisting of at least one sheet of work material, said method comprising the steps of, providing a cutting machine having a machine frame a cutting station fixed relative to said machine frame, and a cutting tool movable relative to said machine frame at said cutting station in X and Y coordinate directions to cut lines in material located at said cutting station, providing a quantity of the work material such as aforesaid having a length in said X coordinate direction greater than the length of said cutting station in said X coordinate direction, cutting pattern pieces from said work material by first positioning a first segment of said work material at said cutting station and moving said cutting tool in said X and Y coordinate directions to cut lines defining pattern pieces in said first segment and then advancing said material in said X coordinate direction to bring an adjacent segment of said work material to said cutting station and then cutting said adjacent section by moving said tool in said X and Y coordinate directions to cut lines defining pattern pieces in said adjacent section, and when a particular one of said pattern pieces extends from said first segment into said adjacent segment performing extra cuts in said material in the vicinity of the points at which the line defining said particular pattern piece extends between said first segment and said adjacent segment to achieve retrace cutting along portions of said line in the vicinity of said points.

14. A method of cutting a line in work material as defined in claim 13 further characterized by:

providing a set of marker data defining both peripheral lines describing said pattern pieces and lines defining said extra cuts, and using said marker data to drive said cutting tool so as to execute both the cutting of said peripheral lines and the cutting of said extra cuts in said work material.

15. A method of cutting a line in work material as defined in claim 13 further characterized by, providing a set of marker data defining peripheral lines describing said pattern pieces, providing a controller including a computer for controlling the movement of said cutting tool, supplying said marker data to said controller, using said marker data and said controller to supply cutting instructions to drive said cutting tool to cut said peripheral lines in said work material, and using said computer to process said marker data to provide additional cutting instructions for cutting said extra cuts, and controlling said cutting tool in response to said additional cutting instructions to drive said cutting tool to cut said extra cut in said work material.

16. A method of cutting a line in work material as defined in claim 15 further characterized by:

said step of using said computer to process said marker data to provide additional cutting instructions being performed by retaining in a memory of said computer a portion to said marker data representing a trailing edge of said first segment, and then after said material is advanced to bring said adjacent segment to the cutting station adding said memory retained portion of the marker data to the marker data representing said adjacent segment.

* * * * *